US008763573B2

(12) United States Patent
Weber

(10) Patent No.: US 8,763,573 B2
(45) Date of Patent: Jul. 1, 2014

(54) CAMSHAFT ADJUSTING ARRANGEMENT

(75) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 497 days.

(21) Appl. No.: 12/950,625

(22) Filed: Nov. 19, 2010

(65) Prior Publication Data

US 2011/0120399 A1 May 26, 2011

(30) Foreign Application Priority Data

Nov. 20, 2009 (DE) ..... 10 2009 054 049

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17; 123/90.15

(58) Field of Classification Search
USPC ..... 123/90.15, 90.17; 29/888.1
See application file for complete search history.

(56) References Cited

U.S. PATENT DOCUMENTS 5,337,711 A * 8/1994 Hampton ..... 123/90.17
6,024,061 A * 2/2000 Adachi et al. ..... 123/90.17
6,250,266 B1 * 6/2001 Okui et al. ..... 123/90.17
6,302,072 B1 * 10/2001 Sekiya et al. ..... 123/90.17
6,332,439 B2 * 12/2001 Sekiya et al. ..... 123/90.17
6,619,248 B1 * 9/2003 Bertelshofer et al. ..... 123/90.15
7,389,756 B2 * 6/2008 Hoppe et al. ..... 123/90.17
7,849,825 B2 * 12/2010 Scheidig et al. ..... 123/90.12
7,874,273 B2 * 1/2011 Hertrich et al. ..... 123/90.17
8,051,818 B2 * 11/2011 Myers et al. ..... 123/90.17
8,096,273 B2 * 1/2012 Myers et al. ..... 123/90.17
8,113,159 B2 * 2/2012 Myers et al. ..... 123/90.17
2001/0039932 A1 * 11/2001 Sekiya et al. ..... 123/90.17
2002/0000213 A1 * 1/2002 Fukuhara et al. ..... 123/90.17
2005/0109299 A1 * 5/2005 Takahashi et al. ..... 123/90.17
2007/0095315 A1 * 5/2007 Hoppe et al. ..... 123/90.17
2007/0245991 A1 * 10/2007 Weber ..... 123/90.17
2010/0089353 A1 * 4/2010 Myers et al. ..... 123/90.17
2011/0297113 A1 * 12/2011 Arnold ..... 123/90.15
2012/0204822 A1 * 8/2012 Weber ..... 123/56.2

FOREIGN PATENT DOCUMENTS

DE 10 2004 038 695 A1 2/2006
DE 10 2006 039 371 A1 2/2008

* cited by examiner

*Primary Examiner* — Thomas Denion
*Assistant Examiner* — Steven D Shipe
(74) *Attorney, Agent, or Firm* — Davidson, Davidson & Kappel, LLC

(57) ABSTRACT

A camshaft adjusting arrangement for varying angular position of a camshaft relative to a crankshaft of an internal combustion engine which has a drive element that is driven by the crankshaft and is rotatable in relation to the camshaft, at least two hydraulic chambers, to which a hydraulic fluid can be admitted to set a defined relative rotational position between the drive element and camshaft, formed between the drive element and camshaft, a first component and a second component. The first component has a cylindrical receiving face which receives a cylindrical seating face of the second component. To keep the resulting radial compressive stress between the components within an admissible range, at least one compensating element is arranged in the cylindrical receiving face of the first component and/or in the cylindrical seating face of the second component.

7 Claims, 3 Drawing Sheets

CAMSHAFT ADJUSTING ARRANGEMENT

This application claims the priority of DE 10 2009 054 049.0 filed Nov. 20, 2009, which is incorporated by reference herein.

FIELD OF THE INVENTION

The invention relates to a camshaft adjusting arrangement for varying the angular position of a camshaft relative to a crankshaft of an internal combustion engine, the camshaft adjusting arrangement comprising a drive element, which is driven by the crankshaft and is supported so that it can rotate in relation to the camshaft, at least two hydraulic chambers, to which a hydraulic fluid can be admitted in order to set a defined relative rotational position between the drive element and the camshaft, being formed between the drive element and the camshaft, the camshaft adjusting arrangement comprising a first component and a second component, the first component having a cylindrical receiving face which is designed to receive a cylindrical seating face of the second component.

BACKGROUND OF THE INVENTION

Camshaft adjusting devices, particularly those working hydraulically, are sufficiently well-known in the prior art. In the hydraulic camshaft adjuster there is a vane impeller, in which vanes are formed or arranged. The vanes are situated in hydraulic chambers, which are incorporated in an external rotor. The internal rotor (connected to the camshaft) can be adjusted relative to the external rotor between an 'advanced stop' and a 'retarded stop' by way of corresponding admission of hydraulic fluid to the respective side of the hydraulic chambers. The flow of hydraulic oil is here controlled by an electrically actuated directional valve.

The rotary motion of the crankshaft is generally transmitted to the external rotor via a gearwheel, which is rotationally fixed to the external rotor. In the prior art there are known solutions in which the gearwheel is embodied as a chain sprocket and is arranged at the outer circumference of the external rotor or rotationally fixed to the external rotor.

A camshaft adjusting device of generic type is described in DE 10 2004 038 695 A1. Here the drive element has a laterally attached and fixed covering element. An axial end section of the drive element or its housing in this case has a cylindrical receiving face.

The covering element is seated on the receiving face by way of a corresponding seating face. In order to afford the covering element sufficient grip on the axial end section of the drive element or its housing, a press-fit is here provided between the cylindrical receiving face and the cylindrical seating face.

DE 10 2006 039 371 A1 shows a similar solution. Here too, the camshaft adjuster has a drive element, which is rotationally fixed to the crankshaft. An output element, which is rotationally fixed to the camshaft, is rotatable relative to the drive element. The device is axially limited by a side cover at each side.

A torsion spring in the form of a flat spiral spring is also provided. A first end of the torsion spring acts on the output element. The other end of the torsion spring is fixed to the drive element. The torsion spring is here under a pre-tension, so that it can exert a torque on the output element relative to the drive element. The torsion spring serves to compensate for a friction torque, which acts on the camshaft and pushes the output element towards retarded timings. The torsion spring is further provided in order to move the output element into a basic position in which the output element can be mechanically locked to the drive element should the hydraulic medium supply to the device become insufficient.

The torsion spring is arranged in a spring compartment, which is delimited on the one hand by the side cover and on the other by the aforementioned covering element (spring cover). The covering element grips radially and axially over the side cover and is provided with a positively interlocking element.

A disadvantage of the hitherto known solutions is that although the first component and the second component, that is to say, in particular, the front or side cover of the drive element and the covering element, are cost-effective to produce, the production tolerances mean that the press-fit between the two parts, that is to say the radial compressive stress between the two cylindrical contact faces between said parts, which constitute a transverse press-fit, cannot be kept sufficiently precisely within a predefined tolerance band.

OBJECT OF THE INVENTION

The object of the present invention therefore is to develop a camshaft adjusting arrangement of the aforementioned type so that it is possible to purposely keep the radial compressive stress, which in the assembled state results between said first and second component, particularly between the front or side cover and the covering element, within an admissible range. The intention is thereby to keep the press-fit between the parts within a defined range without special precautions for the production of the parts. At the same time it is intended to fully maintain cost-effective production of the parts.

SUMMARY OF THE INVENTION

This object is achieved by the invention, which is characterized in that in order to reduce a radial compressive stress between the first component and the second component at least one compensating element is arranged in the cylindrical receiving face of the first component and/or in the cylindrical seating face of the second component.

The compensating element is preferably embodied as a groove-like recess, which extends over a defined angle over the circumference of the first component and/or the second component. The angle here is preferably between 10° and 25°. The axial extent of the compensating element is preferably the entire contact area between the two components along the cylindrical receiving or seating face.

Two, three or four compensating elements are preferably arranged over the circumference of the cylindrical receiving face and/or the cylindrical seating face. These are preferably arranged equidistantly over the circumference.

The groove-like recess is preferably let into the cylindrical receiving face of the first cornponent.

In axial section the groove-like recess may have largely radially extending lateral boundaries. These boundaries may merge via a rounding into a base section of the groove-like recess.

The first component is preferably a front cover of the drive element. The second component is preferably a covering element of the drive element. This may be produced as a thin sheet-metal component.

The invention is here geared to the concept that the compensating element in the cylindrical receiving face of the first component and/or in the cylindrical seating face of the second component will make it possible to match the circumferences of the cylindrical receiving face and the cylindrical seating face. This serves to reduce the radial compressive stress.

According to the invention at least one compensating element is proposed, which on the outer and/or inner component generates an elastic-plastic spring action in the transverse press-fit. This elastic-plastic variation of the circumferential faces of the two interacting components has a corresponding influence on the compressive stress between the components. The compensating element may be formed as a radial impression inwards or outwards. Given the minimal overlap of the components, residual stresses resulting from the manufacturing process will cause the compensating element to generate a minimum, essential residual pre-tensioning force in the transverse press-fit. With a greater overlap the compensating element allows an elastic or even plastic deformation in a circumferential direction, producing a variation in the effective circumferential length of one of the two components. The transverse press-fit is correspondingly limited to a maximum admissible radial compressive stress.

In a transverse press-fit with a thin-walled cylindrical component a predefined overlap is therefore very easy to establish. This is therefore an easy way of compensating for production tolerances.

The invention serves to compensate for an increased overlap in the transverse press-fit between the cylindrical components, which are joined to one another axially to the transverse press-fit (that is to say by pressing on axially). The residual force pre-tensioning in the transverse press-fit and hence also the axial joining force can thereby be more readily controlled and/or limited.

In the case of a zero overlap in the transverse press-fit the two components will theoretically have the same circumferential lengths at the joining face. The compensating element in the form of a radial segmental recess constitutes an enlargement or a reduction of the effective circumferential area of one of the two interacting components which is approximately equal to the circumferential length of the one component at maximum admissible overlap.

The compensating elements in this respect constitute elastic spring elements in the circumferential direction of the transverse press-fit, which, depending on the size of the overlap in the circumferential direction, allow a radial deformation inwards or outwards, which leads to a variation in the effective circumferential length of the component.

The compensating characteristic may also be plastically deformed locally. In this case the necessary residual pre-tensioning force in the transverse press-fit is produced by a residual elasticity of the compensating element.

The radial impression of the compensating element may be formed by shallow radial transitions to the basic body of the component.

In order to allow the radial expansion in the area of the compensating element, a radial segmental recess may be provided in the other component opposite the compensating element. The minimum depth of the recess is determined according to the necessary radial deformation of the compensating element.

The design configuration of the compensating elements with verification of the stress state and the expansion of the compensating element can be undertaken by a finite element analysis and supported by corresponding tests.

The axial joining force during assembly may be force-travel controlled in order to produce the optimum transverse press-fit.

The proposed invention therefore serves purposely to produce a maximum admissible overlap in the transverse press-fit of the thin-walled components without having to sacrifice economic production of the joining faces. The joining forces in the assembly line are thereby reduced while ensuring the fatigue strength of the components in the transverse press-fit at no additional cost.

BRIEF DESCRIPTION OF THE FIGURES

Exemplary embodiments of the invention are represented in the drawings, in which.

DETAILED DESCRIPTION OF THE FIGURES

Figure 1:
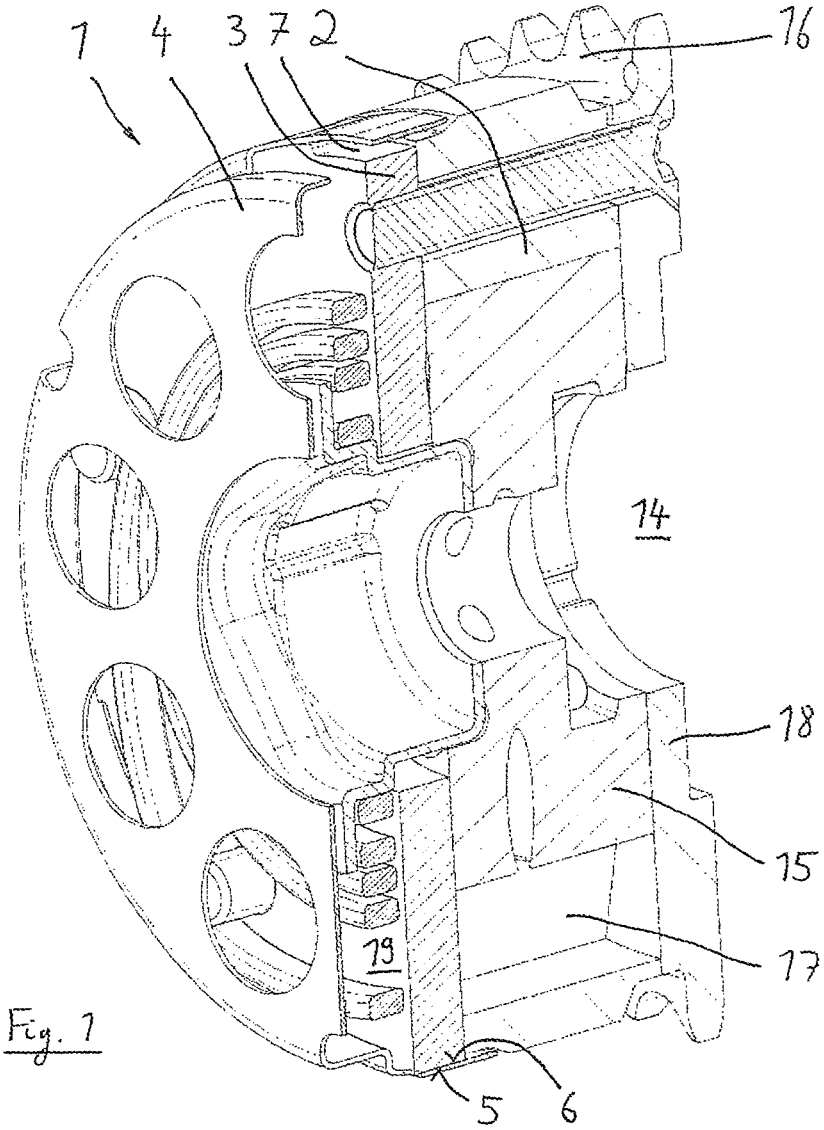
FIG. 1 shows a perspective, sectional view through a camshaft adjusting arrangement.

FIG. 1 represents a camshaft adjusting arrangement 1 for varying the angular position of a camshaft (not shown) relative to a crankshaft (not shown) of an internal combustion engine. The camshaft would be located at the point marked by 14.

An essential constituent part of the camshaft adjusting arrangement 1 is a drive element 2, which incorporates a hydraulic adjusting device, which is capable of bringing about an angular rotation between an outer annular part (stator) and a rotor 15, in order to influence the timings of the internal combustion engine in a known manner. The rotor 15 is rotationally fixed to the camshaft 14. The drive element 2 is driven by the crankshaft of the internal combustion engine, a gearwheel 16 being shown which is fixedly connected to the drive element 2. The crankshaft is connected to the gearwheel 16 by way of a chain (not shown).

Hydraulic chambers, one of which is denoted by 17, are located in the camshaft adjusting arrangement 1. The hydraulic chamber 17 is here delimited radially inwards by the rotor 15 and radially outwards by the stator or drive element 2; laterally the hydraulic chamber is delimited by two side covers, that is to say by a front cover 3, which is here referred to as the first component, and by a rear cover 18.

Multiple hydraulic chambers 17, to each of which hydraulic fluid can be admitted in order to be able to adjust said rotation, are effectively located between the drive element 2 and the rotor 15. Multiple pairs of hydraulic chambers are here arranged over the circumference.

Connected to the front cover 3 is a covering element 4, which is here referred to as the second component. The covering element 4, relative to the front cover 3, defines a receiving space 19, in which a torsion spring 20 is arranged, the purpose of which has already been described above.

Figure 2:
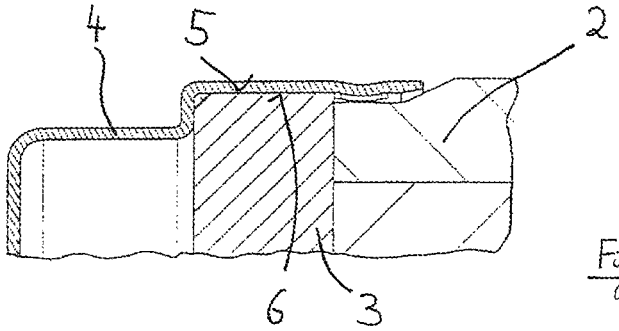
FIG. 2 shows a detail of the camshaft adjusting arrangement in radial section, that is to say the transition of a covering element to a front cover.

As can be seen from a comparison of FIGS. 1 and 2, the first component 3 comprises a cylindrical receiving face 5, on which the second component 4 is mounted with a cylindrical seating face 6. More precisely speaking, the second component 4 is fitted by pressing it axially onto the first component 3, thereby here forming a transverse press-fit.

Figure 3:
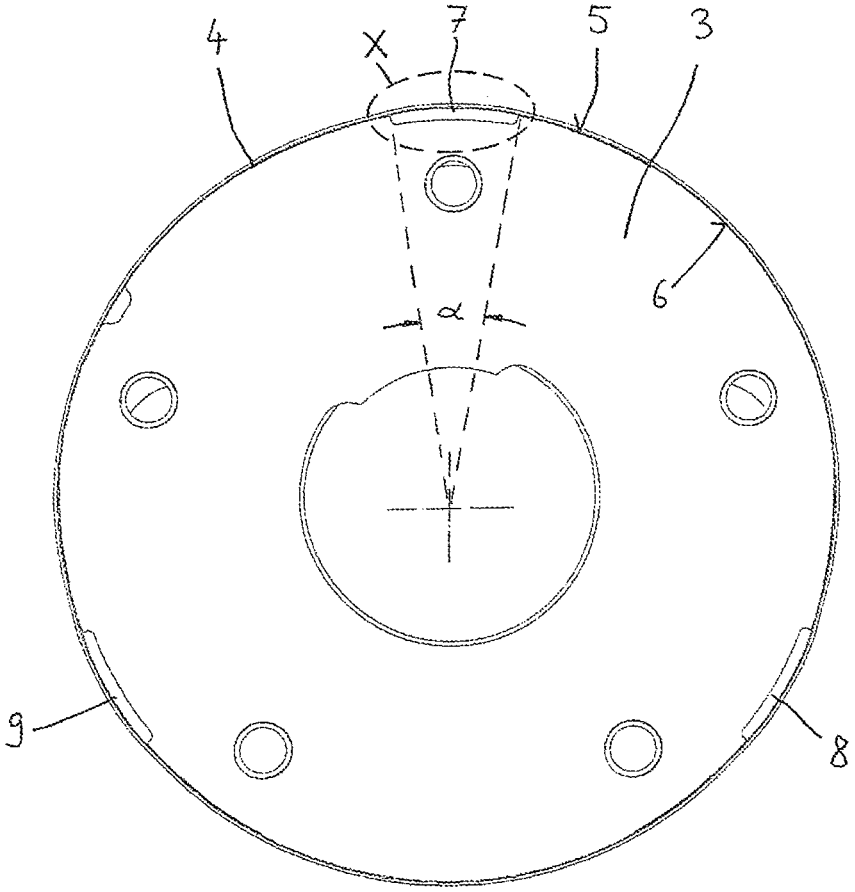
FIG. 3 shows a section of the front cover and the covering element in the fitted state, viewed in the axial direction of the camshaft adjusting arrangement.
Figure 4:
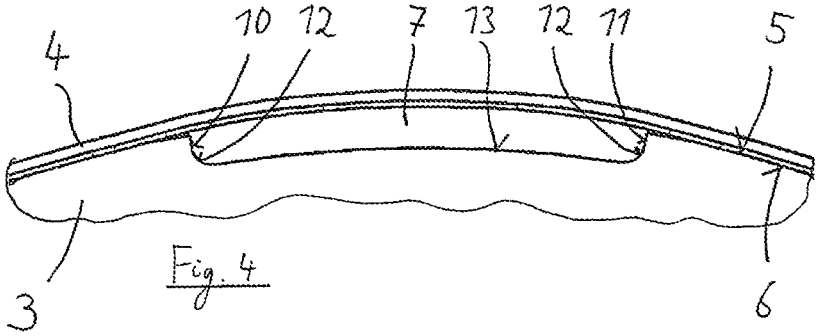
FIG. 4 shows the detail 'X' according to FIG. 3, FIG. 5*a* and FIG. 5*b* schematically show two joined parts, which form a transverse press-fit, FIG. 6*a* and FIG. 6*b* again schematically show two joined parts, which form a transverse press-fit, one of the parts now being provided with compensating elements for controlling the magnitude of the compressive stress between the parts, FIG. 7*a* again schematically shows two parts joined to give a transverse press-fit, and FIG. 7*b* again schematically shows two joined parts, which form a transverse press-fit, the other part, compared to FIG. 6, now being provided with compensating elements for controlling the magnitude of the compressive stress between the parts.

In order to purposely influence the level of the radial compressive stress in the transverse press-fit, the exemplary embodiment provides for a design configuration as shown to best advantage in FIGS. 3 and 4.

According, to these, three compensating elements 7, 8 and 9 in the form of groove-like recesses are let into the first component 3.

Each compensating element 7, 8, 9 extends over a circumferential section, which is specified by the angle α (see FIG. 3). This angle is here somewhat less than 20° and is selected so that the groove-like recesses 7, 8, 9 are of such a size (in a circumferential direction) that the radial compressive stress between the components 3 and 4, that is to say in the contact area between the faces 5 and 6, assumes a still admissible maximum value.

In the exemplary embodiment the groove-like recesses 7, 8, 9 have largely radially extending lateral boundaries 10 and 11 (see FIG. 4), which merge via a rounding 12 into a base section 13.

Figure 6A:
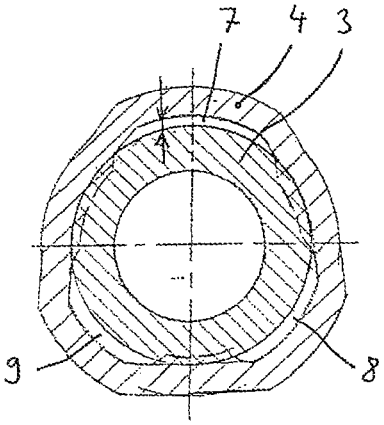
Figure 6B:
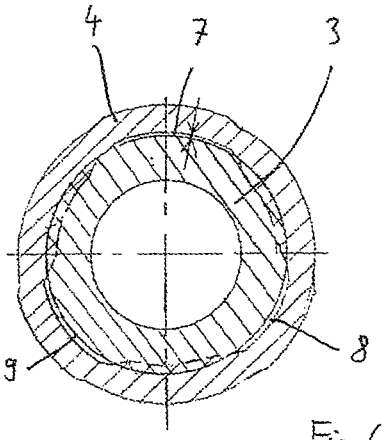
Figure 7A:
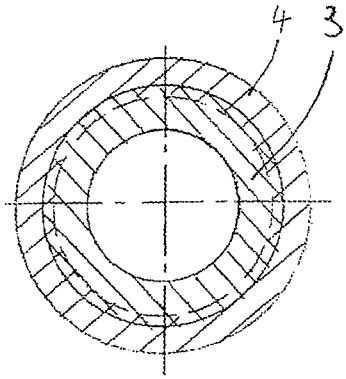

In FIGS. 5 to 7 the proportions are again illustrated schematically with and without the use of the proposed compensating elements.

Figure 5A:
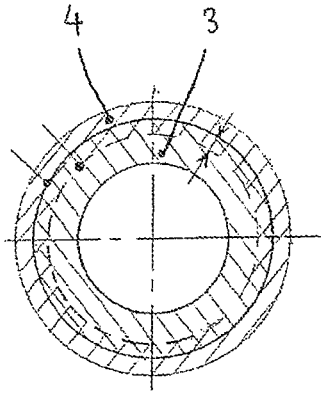
Figure 5B:
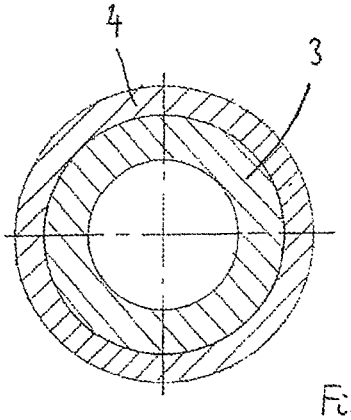

FIG. 5*a* and FIG. 5*b* show two interacting components 3 and 4, which are conventionally joined. Subject to the fit, a compressive stress is produced in the transverse press-fit which given corresponding production tolerances may prove to be too high.

It can be seen from FIG. 6*a* and FIG. 6*b* that the outer component 4 is now no longer produced with a rotationally symmetrical design but is provided with compensating elements 7, 8, 9. Subject to the particular geometry of the parts, the remaining radial gaps between the two components 3 and 4 may become larger or smaller in the area of the compensating elements 7, 8, 9, so that in the event of an excessive overlap the compressive stress can be reduced (thereby reducing the gap size), so that a limit is not exceeded.

Figure 7B:
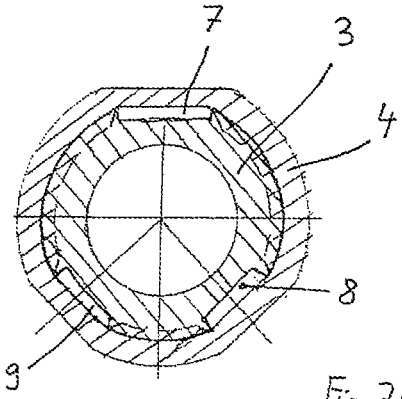

The same applies to the solution according to FIG. 7*b*, in which the compensating elements 7, 8, 9 are let into the component 3 (as in the solution according to FIGS. 1 to 4). The drawing exaggerates the way in which the outer component 4 is deformed in the area of the groove-like recesses 7, 8, 9 and reduces its circumferential length, so that the compressive stress between the components 3, 4 can be reduced.

LIST OF REFERENCE NUMERALS

1 Camshaft adjusting arrangement
2 Drive element
3 First component (front cover)
4 Second component (covering element)
5 Cylindrical receiving face
6 Cylindrical seating face
7 Compensating element (groove-like recess)
8 Compensating element (groove-like recess)
9 Compensating element (groove-like recess)
10 Lateral boundary
11 Lateral boundary
12 Rounding
13 Base section
14 Camshaft
15 Rotor
16 Gearwheel
17 Hydraulic chamber
18 Rear cover
19 Receiving space
20 Torsion spring
α angle

The invention claimed is:

1. A camshaft adjusting arrangement for varying an angular position of a camshaft relative to a crankshaft of an internal combustion engine, the camshaft adjusting arrangement, comprising:

a drive element, which is driven by the crankshaft and is supported so as to be rotatable in relation to the camshaft, at least two hydraulic chambers, to which a hydraulic fluid can be admitted in order to set a defined relative rotational position between the drive element and the camshaft, being formed between the drive element and the camshaft a first component and a second component, the first component having a cylindrical receiving face which is designed to receive a cylindrical seating face of the second component, the first component being a cover plate of the drive element and the second component being a covering element, wherein in order to reduce a radial compressive stress between the first component and the second component, at least one compensating element is arranged in the cylindrical receiving face of the first component and/or in the cylindrical seating face of the second component, and wherein the compensating element is a groove-like recess, which extends over a defined angle over a circumference of the first component and/or the second component, and wherein the groove-like recess has largely radially extending lateral boundaries at circumferential ends of the groove-like recess.

2. The camshaft adjusting arrangement according to claim 1, wherein the angle is between 10° and 25°.

3. The camshaft adjusting arrangement according to claim 1, wherein two, three or four compensating elements are arranged over a circumference of the cylindrical receiving face and/or the cylindrical seating face.

4. The camshaft adjusting arrangement according to claim 3, wherein the two, three or four compensating elements are arranged equidistantly over the circumference.

5. The camshaft adjusting arrangement according to claim 1, wherein the groove-like recess is incorporated into the cylindrical receiving face of the first component.

6. The camshaft adjusting arrangement according to claim 1, wherein the largely radially extending lateral boundaries merge via a rounding into a base section of the groove-like recess.

7. A camshaft adjusting arrangement for varying an angular position of a camshaft relative to a crankshaft of an internal combustion engine, the camshaft adjusting arrangement, comprising:

a drive element, which is driven by the crankshaft and is supported so as to be rotatable in relation to the camshaft, at least two hydraulic chambers, to which a hydraulic fluid can be admitted in order to set a defined relative rotational position between the drive element and the camshaft, being formed between the drive element and the camshaft a first component and a second component, the first component having a cylindrical receiving face which is designed to receive a cylindrical seating face of the second component, the first component being a cover plate of the drive element and the second component being a covering element, wherein in order to reduce a radial compressive stress between the first component and the second component, at least one compensating element is arranged in the cylindrical receiving face of the first component and/or in the cylindrical seating face of the second component, and wherein the compensating element is a groove-like recess, which extends over a defined angle over a circumference of the first component and/or the second component, the angle being between 100 and 25°.

* * * * *